United States Patent [19]

Pitts, Jr. et al.

[11] 4,042,824

[45] Aug. 16, 1977

[54] DUAL SPECTRA WELL LOGGING SYSTEM AND METHOD

[75] Inventors: Robert W. Pitts, Jr.; Houston A. Whatley, Jr., both of Houston, Tex.

[73] Assignee: Texaco Inc., New York, N.Y.

[21] Appl. No.: 643,261

[22] Filed: Dec. 22, 1975

[51] Int. Cl.[2] ..... G01V 5/00

[52] U.S. Cl. ..... 250/263; 250/264

[58] Field of Search ..... 250/263, 264

[56] References Cited

U.S. PATENT DOCUMENTS

| | | | |
|---|---|---|---|
| 2,659,014 | 11/1953 | Scherbatskoy | 250/263 |
| 2,740,053 | 3/1956 | Scherbatskoy | 250/262 |
| 2,911,536 | 11/1959 | Scherbatskoy | 250/263 |
| 3,142,757 | 7/1964 | Basham | 250/264 |
| 3,925,749 | 12/1975 | McLaughlin | 250/263 |

*Primary Examiner*—Harold A. Dixon

*Attorney, Agent, or Firm*—Thomas H. Whaley; Carl G. Ries; Ronald G. Gillespie

[57] ABSTRACT

A well logging system and method in which a transmitter in a borehole has at least two radiation detectors sensing either the same condition or two different conditions relating to the earth's formation traversed by the borehole and providing pulse signals having reference pulses and data pulses corresponding in number and peak amplitude to the sensed condition. Each pulse signal is sampled at different times by a sampling circuit which provides pulses of opposite polarity whose amplitudes correspond to the amplitudes of the first pulses occurring during sampling periods. The pulses from the sampling circuit are conducted to surface electronics by a single conductive path such as the inner conductor and the shield of an armored coaxial cable. The surface electronics include a pulse separation circuit which separates the pulses polarity. Processing circuits process the separated pulses to provide records of at least two spectra.

15 Claims, 3 Drawing Figures

DUAL SPECTRA WELL LOGGING SYSTEM AND METHOD

BACKGROUND OF THE INVENTION

1. Field of the Invention

The present invention relates to well logging systems in general and, more paticularly, to the transmission and processing of signals in a well logging system.

2. Description of the Prior Art

Heretofore dual spectra well logging systems such as the type described in U.S. Application No. 517,131, filed Oct. 23, 1974, now U.S. Pat. No. 3,959,648 and assigned to Texaco Inc., assignee of the present invention, provided for sampling pulses from a detector in which the output pulses transmitted uphole corresponded to the largest amplitude pulse in the sample. Although such a system may be satisfactory, it does involve certain inaccuracies with the transmitted data. All of the data transmitted uphole is biased by the fact that only the largest amplitude pulse is used to derive the transmitted pulses. The present invention distinguishes over that type of system and increases the accurracy by providing the transmitted pulses as a function of the first pulse occurring in the sample, regardless of its amplitude.

SUMMARY OF THE INVENTION

A well logging system provides at least two outputs corresponding to at least one condition, related to an earth formation, sensed in a borehole traversing the earth formation. The system includes a logging instrument adapted to be passed through a borehole which has at least two radiation detectors responsive to penetration radiation in a borehole. Each detector provides a pulse signal having reference pulses and data pulses corresponding in number and amplitude to the detected penetration. A pulse output circuit connected to the detectors periodically sample the pulse signal from each detector and provides output pulses corresponding in amplitude and polarity to the sample in a manner so that the output pulses of one polarity are provided during first predetermined intervals and output pulses of another polarity are provided during second predetermined time intervals. The pulse output network includes two circuits, each circuit includes a pulse stretching stage for stretching pulses, a sampling circuit which periodically samples the stretched pulses and provides an output corresponding to the first stretched pulse occuring during each sampling. An output connected to each sampling circuit provides the output pulses of the one polarity in accordance with the output voltage from the one sampling circuit and provides the output pulses of the other polarity in accordance with the output voltage from the other sampling circuit. A logging cable conducts the output pulses from the logging instrument to surface electronics adjacent to the borehole. The surface electronics includes a separation circuit separating the pulses from the cable by polarity. Two processing networks are connected to the separating circuit. Each processing network provides an output in accordance with the pulses provided to it by the separating circuit.

The objects and advantages of the invention will appear more fully hereinafter from a consideration of the detailed description which follows, taken together with the accompanying drawings wherein one embodiment of the invention is offered by way of example. It is to be expressly understood, however, that the drawings are for illustration purposes only and are not to be construed as defining the limits of the invention.

DISCUSSION OF THE DRAWINGS

DESCRIPTION OF THE INVENTION

Figure 1:
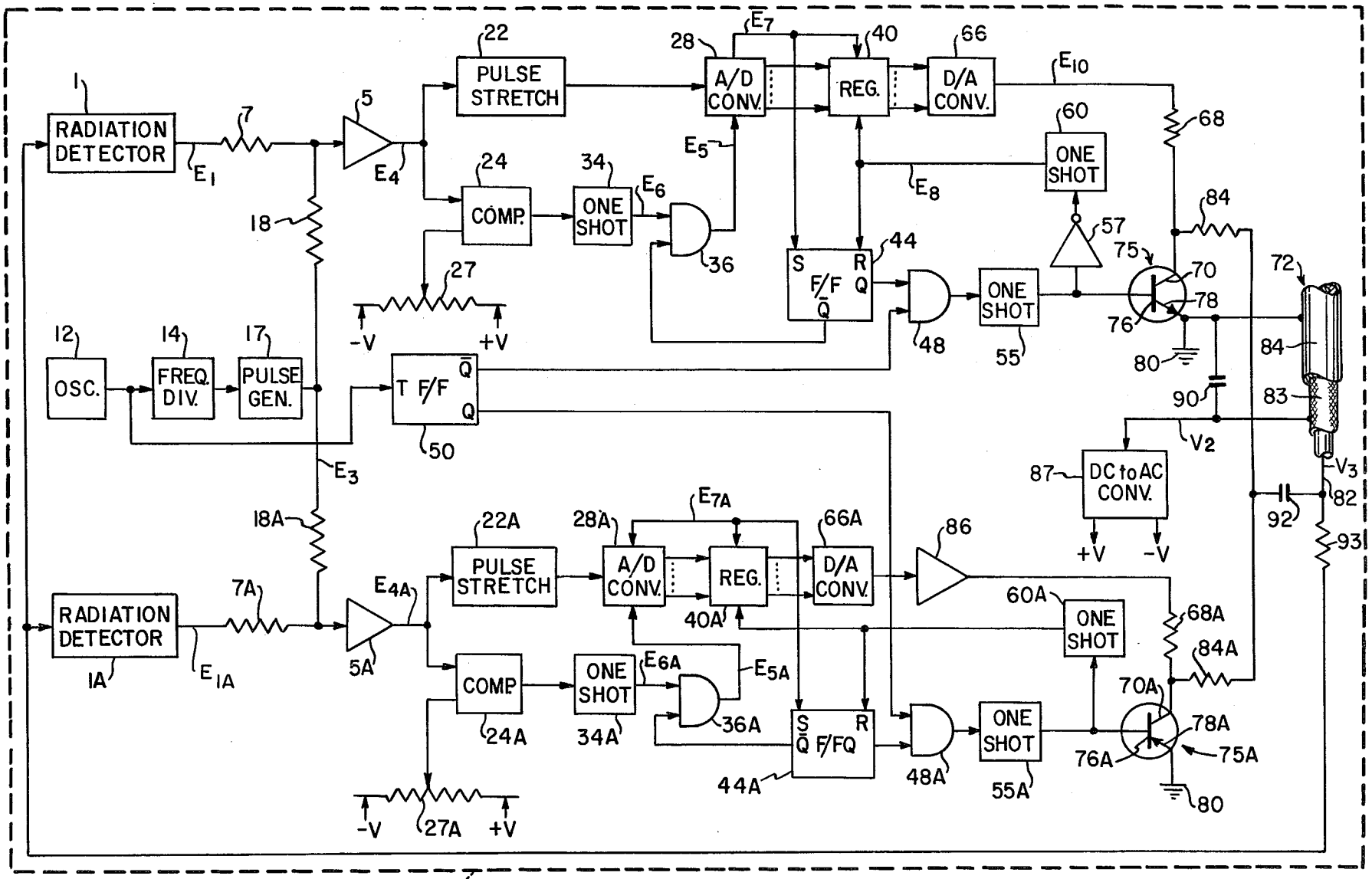
FIG. 1 is a simplified block diagram of a well logging instrument which is part of a well logging system, constructed in accordance with the present invention, for providing records of at least one condition relative to an earth formation traversed by a borehole.
Figure 4:
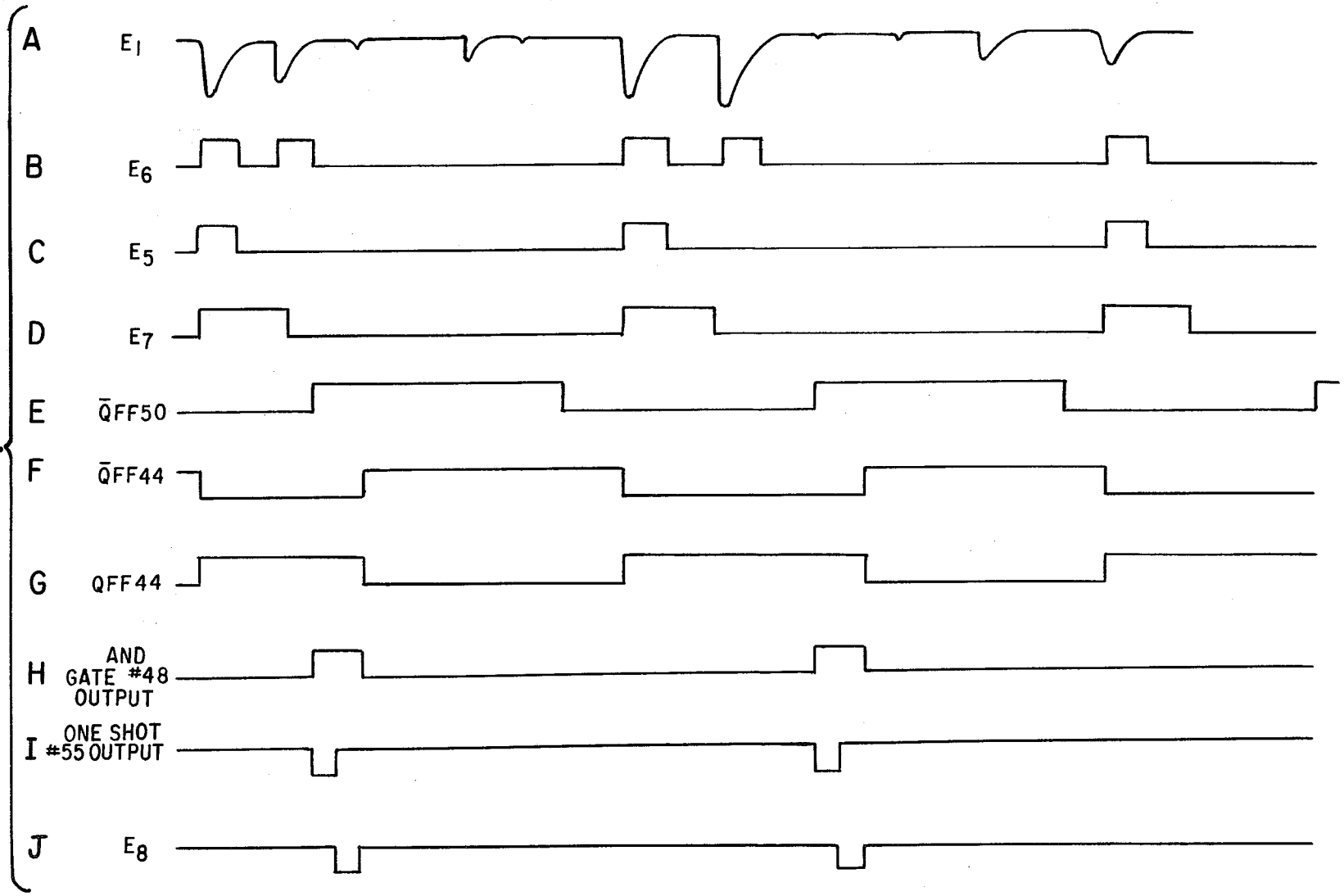
Figures 4A through 4J are graphical representations of waveforms that occur during the operation of the well logging instrument shown in FIG. 1.

Referring to FIG. 1, radiation detectors 1, 1A, which may be of a conventional type in a logging sonde 3, detect gamma radiation and provide electrical data pulses $E_1$ and $E_{1A}$, respectively, corresponding in amplitude and number to detected gamma radiation. Elements identified by a number with a suffix are connected and operate in a similar manner as elements having the same number without a suffix. The detected gamma radiation is relative to at least one condition of an earth formation having a borehole into which logging sonde 3 has been inserted. Data pulses $E_1$, $E_{1A}$ are provided to pre-amps 5 and 5A, respectively, through summing resistors 7 and 7A, respectively a typical signal $E_1$ is shown in FIG. 4A.

An oscillator 12 provides a pulse signal $E_2$ having a frequency corresponding to the maximum frequency of a pulse signal the logging cable being used is capable of handling. A frequency divider 14 divides the frequency of signal $E_2$ to an acceptable frequency for reference pulses to provide pulses which trigger a stabilization pulse generator 17 to provide reference pulses $E_3$ on a one for one basis. One acceptable frequency may be 100 pulses per second. Reference pulses $E_3$ are provided to pre-amps 5, 5A through summing resistors 18 and 18A, respectively, so that pre-amp 5, 5A provides pulse signals $E_4$ and $E_{4A}$, respectively, having data pulses and reference pulses. The amplitudes of the reference pulses are substantially greater than the greatest expected amplitude of the data pulses.

Pulse signal $E_4$ is applied to a pulse stretcher 22 and to a comparator 24. Comparator 24 functions as a low level discriminator by comparing each pulse in pulse signal $E_4$ with a reference level. The level is obtained by applying reference voltages $+V$ and $-V$ across a portentiometer 27, and applying the wiper arm voltage to comparator 24. Adjustment of the wiper arm of potentiometer 27 sets the reference level. Comparator 24 provides a pulse when a pulse in pulse signal $E_4$ occurs which is greater than a threshold value as defined by the reference level.

The stretched pulses provided by pulse stretcher 22 are applied to an analog-to-digital converter 28 which may be of the type sold by Teledyne-Philbrick as their Part No. 4109/410910. However, converter 28 will not convert the analog signal to digital signals until it receives an "enter" pulse $E_5$, shown in FIG. 4C.

Each "enter" pulse $E_5$ is derived from a pulse from comparator 24 as follows. The trailing edge of a pulse from comparator 24 triggers a one-shot multivibrator 34 to provide a pulse $E_6$, as shown in FIG. 4B, to an AND gate 36. When AND gate 36 is enabled, as hereinafter explained, the pulse from one-shot 34 is provided as "enter" pulse to converter 28.

Upon the occurrence of an "enter" pulse $E_5$, the stretched pulse from pulse stretcher $E_{22}$ is converted to digital signals, by analog-to-digital converter 28, which are provided to a register 40. Upon the end of conversion, converter 28 provides a pulse $E_7$ to register 40 for transferring the digital information into register 40 and to a flip-flop 44. Flip-flop 44 provides a $\overline{Q}$ output, as shown in FIG. 4F, to AND gate 36 and a Q output, as shown in FIG. 4G, to another AND gate 48, whose output is shown in FIG. 44. The $\overline{Q}$ output from flip-flop 44 goes to a low level in reponse to a pulse $E_7$ as shown in FIG. 4D, thereby disabling AND gate 36 to block any more pulses $E_6$ should they occur within a predetermined time period as hereinafter described.

The predetermined time period is controlled by the time between pulses of pulse signal $E_2$ from oscillator 12. Pulses $E_2$ are provided to a flip-flop 50 which is used to alternately control operations of the dual channels. The $\overline{Q}$ output of flip-flop 50, which is shown in FIG. 4E, is applied to AND gate 48 so that upon the occurrence of a pulse from oscillator 12, AND gate 48 is enabled until a following pulse $E_2$ occurs. Flip-flop 44's Q output to AND gate 48 is at a high level as a result of the occurrence of a pulse $E_7$, so that the subsequent pulse $E_2$ from oscillator 12 disables AND gate 48 causing its output to go to a low level triggering a one shot multivibrator 55.

One shot 55 provides a negative going pulse which is inverted by an inverter 57. The negative going edge of the inverted pulse is used to trigger another one shot multivibrator 60 which provides a reset pulse $E_8$, as shown in FIG. 4J, to flip-flop 44 and register 40. Pulse $E_8$ resets register 40 and opens AND gate 36 which will enable the next selected pulse to be converted, by converter 28. It can be seen that the first selected data pulse occurring during one cycle of the frequency of oscillator 12 prevents subsequent pulses occurring in that period from affecting the data.

While the channel is in operation, the output from register 40 is applied to a digital to analog converter 66 which provides an analog signal $E_{10}$ whose amplitude corresponds to the digital value of the content of register 40 and hence to the amplitude of the first pulse. Signal $E_{10}$ is applied through a resistor 68 to a collector 70 of a NPN transister 75 having a base 76 and an emitter 78. Emitter 78 is connected to ground 80 while collector 70 is also connected to an inner conductor 82 of an armored coaxial cable 72 through a resistor 84, and a capacitor 92.

When one shot 55 provided a negative pulse output, the negative pulse rendered transistor 75 nonconductive causing the signal $E_{10}$ to build up at collector 70 and be passed through resistor 84 to conductor 82 and capacitor 92. Due to the operation of inverter 57, one shot 60 did not provide a reset pulse $E_8$ until the termination of the pulse from one shot 55. Upon the completion of the pulse from one shot 55, transistor 75 is rendered conductive to effectively ground the collector so that no voltage from converter 66 is applied to conductor 82.

Upon the occurrence of a subsequent pulse $E_2$ from oscillator 12, the other channel operates in a similar manner as the channel heretofore described. It is again noted that those elements having a number and a suffix, comprise the other channel and operate in a similar manner as the elements having the same number without a suffix. It should also be noted that one shot 55A provides a positive pulse to transistor 75A which is a PNP transistor. Therefore there is no corresponding inverter 57A.

Since the output signal $E_{10A}$ is to be applied to inner conductor 82, it is desired that it has a negative polarity for up-hole processing, therefore there is an additional inverter 86 which inverts the output from digital-to-analog converter 66A to provide signal $E_{10A}$ as a negative pulse.

As mentioned hereinbefore, reference pulses $E_3$ are substantially larger than data pulses $E_1$, $E_{1A}$. When, during a sampling period, the first pulse is a reference pulse $E_3$, register 40 provides digital signals corresponding to pulse $E_3$ so that signal $E_{10}$ corresponds to the reference pulse $E_3$. Thus pulses $E_{11}$ will include positive and negative reference pulses necessary to the surface processing of pulses $E_{11}$.

Figure 2:
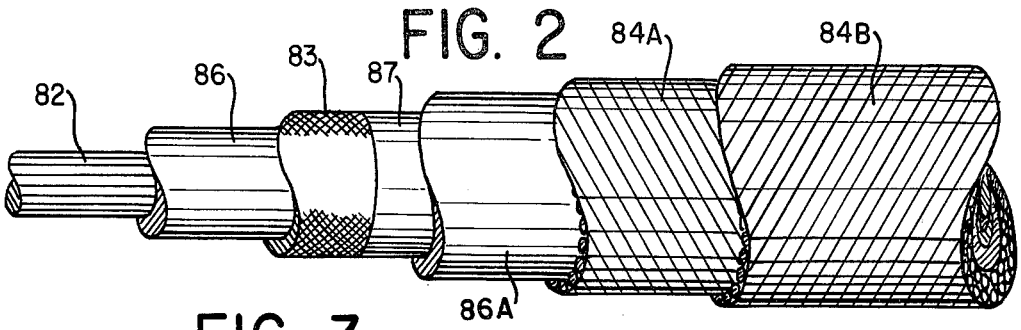
FIG. 2 is a detailed drawing of the cable shown in FIG. 1.

Referring to FIG. 2, cable 72 may be of the type manufactured by the Vector Cable Company under their part number A-4029 and has inner conductor 82, shield 83 and an outer armor 84. Armored coaxial cable 73 is shown in greater detail in FIG. 4. Conductor 82 is No. 16 AWG, 19 strands of 0.0117 inches tinned copper wires. Conductor 82 is separated from shield 80 by a coaxial insulator 86 made of a propylene copolymer dielectric having a wall thickness of 0.062 inches. Shield 83 is No. 36 AWG tinner copper wire, 9 ends, 16 carriers, 10 ppi with 90% coverage. A mylar tape 87 is wrapped around the outer side of the shield 83 with a 45% overlap. Another propylene copolymer dielectric coaxial insulator 86A has a wall thickness of 0.015 inches and separates tape 87 from armor 84. Armor 84 is divided into two sections 84A and 84B. Armor 84A is composed of 18 strands of 0.042 inches galvanized steel wires preformed right lay and has a coating of anti-corrosion compound. Armor 84B is composed of 18 strands of 0.059 inches galvanized steel wires, preformed left lay, and has a coating of an anti-corrosion compound. The opposite lays of the inner and outer armor is to prevent unravelling while in use.

Thus, cable 72 has pulses $E_{11}$ applied across inner conductor 82, coaxial insulator 86 and shield 83, a direct current $V_2$ is applied across shield 80, coaxial insulator 86A and outer armor 84, as hereinafter explained, and a direct current voltage $V_3$ on inner conductor 82 with outer armor 84 as the return path, as hereinafter explained.

Voltage $V_2$ is provided to DC converter 87 which in turn provides the reference voltages $+V$, $-V$. A capacitor 90 connects shield 83 to ground 80 so as to separate AC voltages from voltage $V_2$.

Capacitor 92 prevents voltage $V_3$ from being applied to the transistors 75, 75A while resistor 93 permits voltage $V_3$ to be applied to radiation detectors 1, 1A. Radiation detectors 1, 1A are energized by voltage $V_3$.

Armor 84 is connected to ground 80 to establish a common ground for sonde 3 and the surface electronics.

Figure 3:
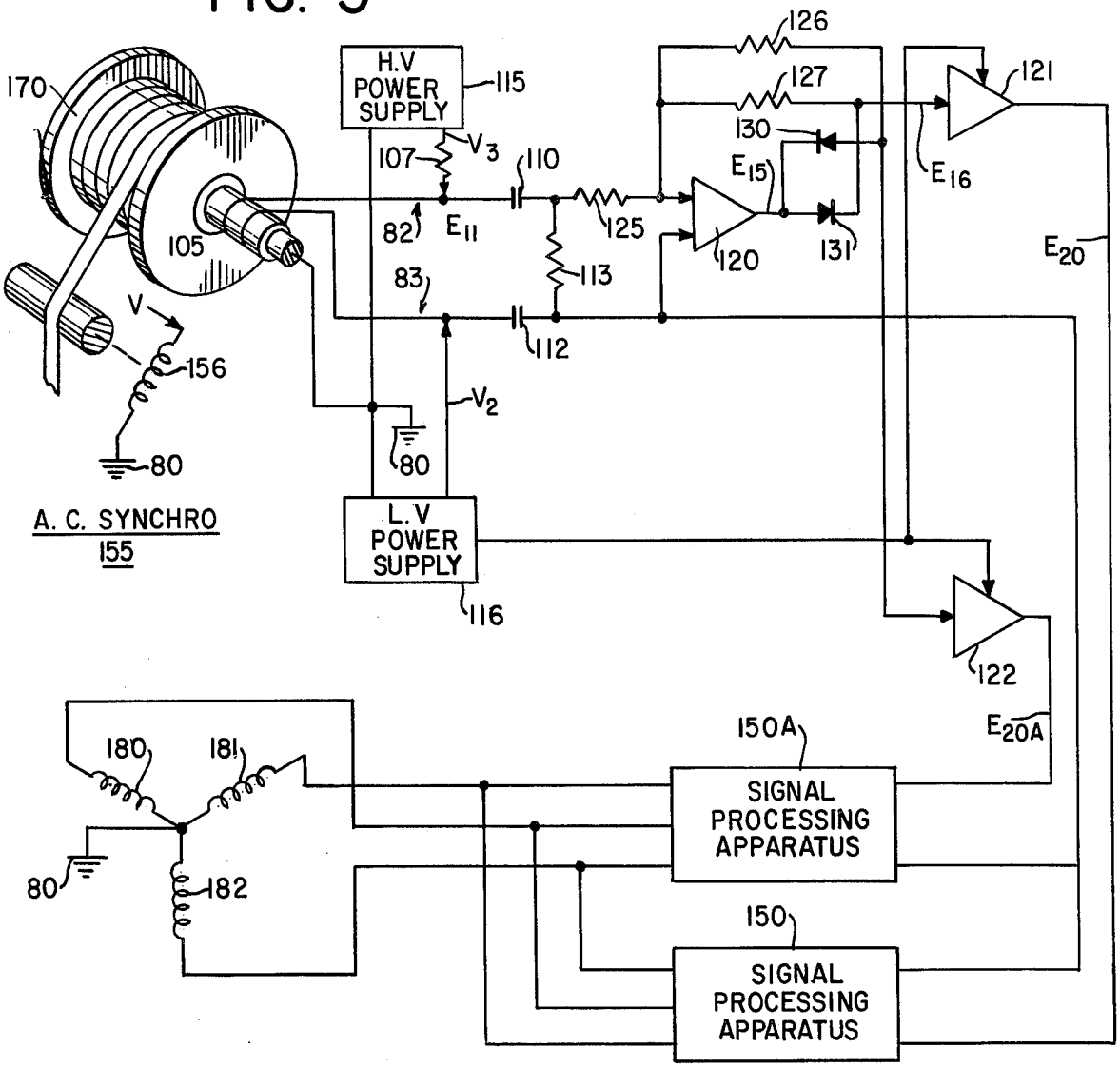
FIG. 3 is a simplified block diagram of a surface electronics, which comprise the remainder of the well logging system, constructed in accordance with the present invention.

Referring to FIG. 3, pulses $E_{11}$ on conductor 82 of cable 72 are provided by slip-rings 105 to a capacitor 110 while the return path for pulses $E_{11}$ is provided by shield 83 of cable 72 through slip-rings 105 and capacitor 112. A high voltage power supply 115 provides voltage $V_3$ through a current limiting resistor 107 and slip-rings 105 to conductor 82 of cable 72. Capacitor 110 blocks voltage $V_3$ while passing pulses $E_{11}$.

A low voltage power supply 116 provides voltage $V_2$ to shield 83 of cable 72 through slip-rings 105. Capacitor 112 blocks voltage $V_2$ while providing a return path for pulses $E_{11}$. A resistor 113 connects capacitor 110 to capacitor 112 and pulses $E_{11}$ are developed across resistor 113.

Amplifiers 120, 121 and 122, resistors 125, 126 and 127 and diodes 130, 131 form a pulse separation circuit which separate the positive pulses $E_{11}$ from the negative pulses $E_{11}$ appearing across resistor 113. Resistors 125, 126 and 127 have the same resistance value.

When a positive pulse $E_{11}$ is applied through resistor 125 to amplifier 120, a positive pulse $E_{15}$ appears at the output of amplifier 120, causing diode 131 to have a very low forward impedance so that the effective gain of amplifier 120 is the ratio of the resistance value of resistor 127 to the resistance value of resistor 125, which is unity. Positive pulse $E_{15}$ is blocked by diode 130 so that no positive pulses $E_{15}$ are applied to amplifier 212.

Amplifier 121 provides a corresponding positive pulse $E_{20}$ which may correspond to a reference pulse or to a sampled data pulse.

Pulse $E_{20}$ are provided to signal processing apparatus 150. Signal processing apparatus may be of the type described in aforementioned U.S. application, which provides a spectral record represented by the sensed condition. When the apparatus is of the type described in aforementioned U.S. application, signal processing apparatus 150 encompasses those elements numbered 50 through 94 and as such includes a spectrum stabilizer, pulse high analyzing means, the signal processing network and recording means.

The spectral record provided by apparatus 150 is correlated to the depth at which the logging instrument 1 is passing through by means of an alternating current synchro 155 receiving a voltage $V_A$ applied to one end of a rotor winding 156 having its opposite end connected to ground 39. Cable 72 is wound on a reel 170 and as it leaves reel 170 it passes over a roller 172. Roller 172 is mechanically connected to rotor winding 156 of synchro 155. As cable 72 moves roller 172, rotor winding 156 rotates accordingly. The voltage across rotor winding 156 is inductively coupled to stator windings 180, 181 and 182 of synchro 155 having a common connection to ground 80. As rotor winding 156 rotates, voltages across stator windings 180, 181, 182 vary as a function of the angular displacement of rotor winding 156. The voltages across 180, 181 and 182 drive the recording means in signal processing apparatus 150, 150A so that the recordings are correlated sensed condition to the depth at which the condition was sensed.

A negative pulse $E_{11}$ results in amplifier 120 providing a negative pulse $E_{15}$ which affects amplifier 120, diode 130 and resistors 125, 126 in the same manner that a positive pulse $E_{15}$ affected amplifier 120, diode 131 and resistors 125, 127. Negative pulse $E_{15}$ passes through diode 131 and is provided to amplifier 122. Amplifier 122 provides pulses $E_{20A}$ to processing apparatus 150A which in turn provides a spectral record in the same manner that processing apparatus 150 simultaneously provides the record of the first spectra.

In another embodiment, sodium iodide crystals in detectors 1, 1A may be doped with an alpha emitting isotope such as Americium 241 or other transuranic isotopes having high energy alpha emission, low intensity and low energy gamma emission. When so doped, the crystals periodically provide a pulse which causes photomultiplier tubes in detectors 1, 1A to provide corresponding reference pulses of sufficient amplitude. Divider 4 and pulse shaper 9 may be eliminated. Amplifiers 5, 5A would be retained, but they would be used for amplification of the pulses from detectors 1, 1A and not for combining signals.

The present invention as heretofore described is a dual spectra well logging system. Two detecting means may either detect one condition, such as chlorine, or two different conditions such as carbon and oxygen, in a borehole. The dual spectra information is transmitted to surface electronics by a single conductive path. The surface electronics provide two spectral recordings of the sensed condition or conditions. The dual spectra well logging systems are not restricted to nuclear well logging since they are applicable to any well logging method whereby one or two conditions are sensed.

Although the well logging system of the present invention has been shown using an armored coaxial cable, it is not restricted in use to an armored coaxial cable. The number of dual spectra logs that may run simultaneously is equal to the number of conductive paths from the downhole instrument to the surface in any logging cable for the providing of such information to the surface.

What is claimed is :

1. A nuclear well logging system for providing outputs corresponding to at least one condition relative to an earth formation sensed in a borehole, comprising a logging instrument adapted to be passed through a borehole, said instrument including at least two detecting means being responsive to penetration radiation corresponding to the condition in the borehole for providing data pulses corresponding in number and peak amplitude to the detected penetration radiation, at least one reference pulse means for providing reference pulses and two pulse signal means, each pulse signal means being connected to a corresponding detecting means and receiving a reference pulse for providing a pulse signal having reference pulses and data pulses, and pulse output means connected to all the pulse signal means for periodically sampling the pulse signals from each pulse signal means and providing output pulses corresponding in amplitude and polarity to the sample in a manner so that output pulses of one polarity are provided during first predetermined time intervals and output pulses of another polarity are provided during second predetermined time intervals, said pulse output means including two network means, each network means including means connected to corresponding pulse signal means for stretching the pulses in the pulse signal from the pulse signal means, sampling means connected to the pulse stretching means for periodically sampling the stretched pulses and providing an output voltage corresponding to the first stretched pulse occurring during each sampling; and circuit means connected to each sampling means for providing the output pulses of the one polarity in accordance with the output voltage from one sampling means and for providing the output pulses of the other polarity in accordance with the output voltage from the other sampling means; conductive means connected between said output pulse means in the logging instrument and surface electronics adjacent the borehole for transmitting the output pulses from the logging instrument to the surface electronics, and said surface electronics comprising means connected to the conductive means for separating the transmitted pulses by polarity, first processing means coupled to the separating means for providing an output corresponding to the sensed condition in accordance with the transmitted pulses of one polarity, and second processing means connected to the pulse separating means for providing a second output corresponding to the sensed condition in accordance with the transmitted pulses of the other polarity.

2. A nuclear well logging system as described in claim 1 in which two outputs corresponding to two conditions are provided, one detecting means detecting penetration radiation corresponding to one condition, the other detecting means detecting radiation corresponding to the other condition; the output pulses of one polarity correspond to one condition while the output pulses of the other polarity correspond to the other condition; the output from the first processing means correspond to the one condition; and the output from the second processing means correspond to the other condition.

3. A nuclear well logging system as described in claim 2 in which each sampling means includes discrimination means connected to a corresponding pulse signal means and receiving a direct current reference voltage for discriminating pulses in the pulse signal provided by the pulse signal means from noise and providing a pulse when a pulse in the pulse signal occurs.

4. A nuclear well logging system as described in claim 3 further comprising means for providing sampling pulses at difference times to each sampling means, and each sampling means includes an analog-to-digital converter means connected to a corresponding pulse stretcher for converting a stretched pulse to digital signals in response to a "convert" pulse and providing an "end of conversion" pulse upon completion of the conversion, register means connected to the analog-to-digital converter means for storing the digital signals from the analog-to-digital converter means in response to the "end of conversion" pulse and providing digital signals corresponding to the stored digital signals, digital-to-analog converter means connected to the register means for providing the output voltage in accordance with the digital signals from the register means, a flip-flop, having a set input connected to the analog-to-digital converter means, a reset input, Q and $\overline{Q}$ outputs at high and low logic levels, respectively, in response to an "end of conversion" pulse applied to its set input and the Q and $\overline{Q}$ outputs at low and high logic levels, respectively, in response to a reset pulse applied to its reset input, means connected to the analog-to-digital converter means, to the discriminator means and to the flip-flop for providing a "convert" pulse to the analog-to-digital converter means in response to a pulse from the discriminator means and a high level $\overline{Q}$ output from the flip-flop and for not providing a "convert" pulse when the discriminator means does not provide pulse or when the $\overline{Q}$ output from the flip-flop is at a high logic level, control pulse means connected to the sampling pulse means, to the flip-flop and to the output means for providing a control pulse to the output means when it receives a sampling pulse from the sampling pulse means so as to control the output means to provide the voltage from digital-to-analog converter means as an output pulse and the flip-flop Q output is at a high logic level and for not providing a control pulse when there is no sampling pulse or when the flip-flop Q output is at a low logic level, and reset means connected to the control pulse means, to the reset input of the flip-flop and to the register means for providing a reset pulse upon termination of a control pulse from the control pulse means to the flip-flop and to the register means so as to clear the register means.

5. A nuclear well logging system as described in claim 4 in which the output means includes first switching means connected to one digital-to-analog converter means and to that converter means corresponding control pulse means, to the conductive means and to ground for providing a voltage from the one digital-to-analog converter means during the absence of a control pulse from the control pulse means and for not providing a voltage from the one digital-to-analog converter means during the presence of a control pulse so as to provide an output pulse; and second switching means connected to the other digital-to-analog converter means, to that converter means corresponding control pulse means, to the conductive means and to ground for providing a voltage from the other digital-to-analog converter means during the absence of a control pulse from the control pulse means and for not providing a voltage from the other digital-to-analog converter means during the presence of a control pulse so as to provide an output pulse.

6. A nuclear well logging system as described in clain 5 wherein the penetration radiation is neutroninduced gamma radiation.

7. A nuclear well logging system as described in claim 5 wherein the penetration radiation is natural gamma radiation.

8. A nuclear well logging instrument for providing pulses corresponding to at least one condition, relative to an earth formation sensed in a borehole in the earth formation, and adapted to be passed through a borehole, comprising at least two detecting means being responsive to penetration radiation corresponding to the condition in the borehole for providing data pulses corresponding in number and peak amplitude to the detected penetration radiation, at least one reference pulse means for providing reference pulses and two pulse signal means, each pulse signal means receiving reference pulses and being connected to a corresponding detecting means for providing a pulse signal having reference pulses and data pulses, and pulse output means connected to all the pulse signal means for periodically sampling the pulse signal from each pulse signal means and providing output pulses corresponding in amplitude and polarity to the sample in a manner so that output pulses of one polarity are provided during first predetermined time intervals and output pulses of another polarity are provided during second predetermined time intervals, said pulse output means including two network means, each network means including means connected to corresponding pulse signal means for stretching pulses in the pulse signal from the pulse signal means, sampling means connected to the pulse stretching means for periodically sampling the stretched pulses and providing an output voltage corresponding to the first stretched pulse occurring during each sampling; and circuit means connected to each sampling means for providing the output pulses of the one polarity in accordance with the output voltage from one sampling means and for providing the output pulses of the other polarity in accordance with the output voltage from the other sampling means.

9. A nuclear well logging instrument as described in claim 8 in which two outputs corresponding to two conditions are provided, one detecting means detecting penetration radiation corresponding to one condition, the other detecting means detecting radiation corresponding to the other condition; the output pulses of one polarity correspond to one condition while the output pulses of the other polarity correspond to the other condition.

10. A nuclear well logging system as described in claim 9 in which each sampling means includes discrimination means connected to a corresponding pulse signal means and receiving a direct current reference voltage for discriminating pulses in the pulse signal provided by the pulse signal means from noise and providing a pulse when a pulse in the pulse signal occurs.

11. A nuclear well logging instrument as described in claim 10 further including means for providing sampling pulses at difference times to each sampling means, and each sampling means includes an analog-to-digital converter means connected to a corresponding pulse stretcher for converting a stretched pulse to digital signals in response to a "convert" pulse and providing an "end of conversion" pulse upon completion of the conversion, register means connected to the analog-to-digital converter means for storing the digital signals from the analog-to-digital converter means in response to the "end of conversion" pulse and providing digital signals corresponding to the stored digital signals, digital-to-analog converter means connected to the register means for providing the output voltage in accordance with the digital signals from the register means, a flip-flop, having a set input connected to the analog-to-digital converter means, a reset input, a Q output and a $\overline{Q}$ outputs at high and low logic levels, respectively, in response to an "end of conversion" pulse applied to its set input and the Q and $\overline{Q}$ outputs at low and high logic levels, respectively, in response to a reset pulse applied to its reset input, means connected to the analog-to-digital converter means, to the discriminator means and to the flip-flop for providing a "convert" pulse to the analog-to-digital converter means in response to a pulse from the discriminator means and a high logic level $\overline{Q}$ output from the flip-flop and for not providing a "convert" pulse when the discriminator means does not provide pulse or when the $\overline{Q}$ output from the flip-flop is at a high logic level, control pulse means connected to the sampling pulse means, to the flip-flop and to the output means for providing a control pulse to the output means when it receives a sampling pulse from the sampling pulse means so as to control the output means to provide the voltage from digital-to-analog converter means as an output pulse and the flip-flop Q output is at a high logic level and for not providing a control pulse when there is no sampling pulse or when the flip-flop Q output is at a low logic level, and reset means connected to the control pulse means, to the reset input of the flip-flop and to the register means for providing a reset pulse upon termination of a control pulse from the control pulse means to the flip-flop and to the register means so as to clear the register means.

12. A nuclear well logging system as described in claim 11 in which the output means includes first switching means connected to one digital-to-analog converter means to that converter means corresponding control pulse means, to the conductive means and to ground for providing a voltage from the one digital-to-analog converter means during the absence of a control pulse from the control pulse means and for not providing a voltage from the one digital-to-analog converter means during the presence of a control pulse so as to provide an output pulse; and second switching means connected to the other digital-to-analog converter means, to that converter means corresponding control pulse means, to the conductive means and to ground for providing a voltage from the other digital-to-analog converter means during the presence of a control pulse so as to provide an output pulse.

13. A nuclear well logging system as described in claim 12 wherein the penetration radiation is neutron-induced gamma radiation.

14. A nuclear well logging system as described in claim 12 wherein the penetration radiation is natural gamma radiation.

15. A nuclear well logging method for providing outputs corresponding to at least one condition sensed in a borehole, which comprises the following steps; responding to penetration radiation in the borehole to provide two pulse signals, each pulse signal containing data pulses, corresponding in number and peak amplitude to the detected penetration radiation, and reference pulses; sampling the pulse signals periodically in a manner so as to periodically provide a voltage corresponding to a different first pulse in each sample, the sampling step for each pulse signal includes stretching the pulses in the pulse signal, converting only the first stretched pulse in a sample to digital signals, storing the digital signals; providing output pulses in a manner so that output pulses of one polarity correspond in amplitude to the samples of one pulse signal and are provided during first predetermined time intervals, and output pulses of another polarity correspond in amplitude to the samples of the other pulse signal and are provided during second predetermined time intervals, the output pulse step includes for each set of output pulses providing a voltage in accordance with corresponding stored digital signals, after a time interval and prior to a next sample erasing the stored digital signals so that the voltage goes to zero so as to create an output pulse; conducting the output pulses from the borehole to the surface, receiving the output pulses at the surface; processing the received output pulses of one polarity to provide an output corresponding to the sensed condition; and processing the received output pulses of another polarity to provide a second output corresponding to the sensed condition.

* * * * *